US006257828B1

(12) United States Patent
Bischoff-Beiermann et al.

(10) Patent No.: US 6,257,828 B1
(45) Date of Patent: Jul. 10, 2001

(54) TURBINE BLADE AND METHOD OF PRODUCING A TURBINE BLADE

(75) Inventors: Burkhard Bischoff-Beiermann; Winfried Esser, both of Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/494,777

(22) Filed: Jan. 31, 2000

Related U.S. Application Data

(63) Continuation of application No. PCT/EP98/04529, filed on Jul. 20, 1998.

(30) Foreign Application Priority Data

Jul. 29, 1997 (EP) ..... 97113044

(51) Int. Cl.[7] ..... F01D 5/14

(52) U.S. Cl. ..... 415/200; 415/915; 416/232; 416/241 R

(58) Field of Search ..... 415/191, 200, 415/208.1, 208.2, 915; 416/223 A, 223 R, 232, 241 R, 243, DIG. 5; 164/122.1, 122.2

(56) References Cited

U.S. PATENT DOCUMENTS

| | | | | |
|---|---|---|---|---|
| 2,916,258 | | 12/1959 | Klint . | |
| 3,465,812 | | 9/1969 | Dieters et al. . | |
| 3,867,068 | * | 2/1975 | Corsmeier et al. | 416/97 |
| 4,314,007 | * | 2/1982 | Gessinger | 416/96 R |
| 4,724,891 | | 2/1988 | Brookes . | |
| 5,072,771 | | 12/1991 | Prasad . | |
| 5,299,418 | * | 4/1994 | Kerrebrock | 416/96 R |
| 5,480,285 | * | 1/1996 | Patel et al. | 416/223 A |
| 5,611,670 | * | 3/1997 | Yoshinari et al. | 416/241 R |
| 5,980,209 | * | 11/1999 | Barry et al. | 416/223 A |
| 6,003,587 | * | 12/1999 | Mitsuhashi | 164/122.1 |

FOREIGN PATENT DOCUMENTS

| | | |
|---|---|---|
| 717 865 | 2/1942 | (DE) . |
| 757 189 | 4/1954 | (DE) . |
| 1 007 565 | 5/1957 | (DE) . |
| 22 42 111 | 3/1973 | (DE) . |
| 0 010 538 A1 | 4/1980 | (EP) . |
| 0 750 956 A2 | 1/1997 | (EP) . |

OTHER PUBLICATIONS

"Thermal Analysis from Thermally–Controlled Solidification (TCS) Trials on Large Investment Castings" (Ferro et al.), Superalloys, 1996, the Minerals, Metals and Materials Society 1996, pp. 531–535.

* cited by examiner

*Primary Examiner*—Edward K. Look
(74) *Attorney, Agent, or Firm*—Herbert L. Lerner; Laurence A. Greenberg; Werner H. Stemer

(57) ABSTRACT

A turbine blade, in particular a gas-turbine blade, which extends along a main axis from a root region over a blade body region to a tip region. The turbine blade has a cavity in the blade body region, at least regions of the cavity being surrounded by a blade wall having a small wall thickness. The blade wall is formed of a metallic material having a small average grain size. In addition, a method of producing the turbine blade is further disclosed.

11 Claims, 2 Drawing Sheets

TURBINE BLADE AND METHOD OF PRODUCING A TURBINE BLADE

CROSS-REFERENCE TO RELATED APPLICATION

This is a continuation of copending International Application PCT/EP98/04529, filed Jul. 20, 1998, which designated the United States.

BACKGROUND OF THE INVENTION

Field of the Invention

The invention relates to a turbine blade, in particular a gas-turbine blade, which extends along a main axis from a root region over a blade body region to a tip region. The invention also relates to a method of producing a turbine blade, in particular a gas-turbine blade.

An apparatus and a method of producing castings, in particular gas-turbine blades, having a directionally solidified structure is described in German Patent DE 22 42 111 B. The method and the apparatus serve to produce castings that as far as possible are free from shrink holes. The directional solidification with a single-crystal or columnar structure is achieved by controlling the start of grain growth. When the method is being carried out, a shell mold to be filled with molten metal is set down on a chill plate and heated to a temperature which is in particular 150° C. above the temperature of the melting point of the metal to be cast. The molten metal is poured into the shell mould, and the chill plate with the shell mold is dipped in a cooling-liquid bath. The temperature of the cooling liquid is substantially below the melting point of the metal. The chill plate has already been cooled by the coolant before the metal is poured into the shell mold. For the production of the turbine blade, the metal used is a superalloy, for example Mar-M 200. The shell mold is dipped in the cooling-liquid bath at such a speed that the surface of the cooling-liquid bath does not run ahead of the solidus level, so that the heat dissipation from the mushy zone of the solidifying alloy takes place vertically downward, and the liquid-solid interface remains essentially horizontal.

This is intended to ensure the growth of a single crystal and to prevent nucleation of grains at the surface of the shell mold. During the production of the turbine blade as a single crystal, the shell mold is heated to over 1500° C. The cooling liquid used is liquid tin, which has a temperature of about 260° C. The speed at which the shell mold is dipped in the liquid bath is about 3 m/h. Here, the turbine blade is cast as a solid-material blade from a nickel-base or a cobalt-base alloy in a single-crystal form having an overall length of about 10 cm.

A speed-controlled method of directional solidification as well as a casting produced according to this method are specified in Published, European Patent Application EP 0 010 538 A1. For the directional solidification of a casting, the ratio of a temperature gradient G and a solidification speed R is especially important. For eutectic superalloys, the ratio of G to R must exceed a certain characteristic value, so that directional solidification takes place. Here, the directional solidification is mainly used in order to produce, for a gas turbine, a casting that is a columnar grain structure, a single crystal or a unidirectional eutectic. The method of directional solidification is used in the case of superalloys such as U-700, B-1900, Mar-M 200 and IN-100. Test trials for producing a gas-turbine blade for the first stage of an aircraft engine in a single-crystal form were carried out at a high dipping speed with radiation cooling and alternatively with cooling by a liquid metal. The speed was between 7.5 cm/h and 33 cm/h in the case of radiation cooling. The directionally solidified casting was cast as a solid body.

A hollow turbine blade for gaseous propellants for turbine rotors of small diameter and having few blades is described in Published, Non-Prosecuted German Patent Application DE 1 007 565 A, in which the overall cross section of the blade increases from the root up to the tip. The increase in the cavity cross section from the root up to the tip is so great that the material cross section narrows from the root up to the tip. The turbine blade consists of two parts, which are connected to one another by brazing, welding or the like.

Described in U.S. Pat. No. 2,916,258 is a turbine, in particular a gas turbine or a steam turbine, which has blades of the same length disposed on a rotor in rows lying in the circumferential direction. In this case, each blade has a mass distribution that differs from the mass distribution of all the other blades of the same rows lying in the circumferential direction. As a result, a certain vibration system, which is intended to reduce the vibrations between the blades, is produced.

A casting process for a gas-turbine blade is described in U.S. Pat. No. 5,072,771. In this case, the melt, for example of a nickel-chrome superalloy, is poured into a casting mold in a furnace provided with a heating zone. After the melt has been poured into the casting mold, the latter is moved out of the heating zone. The turbine blade cast in this way has a grain structure with a multiplicity of randomly oriented grains. The turbine blade has a blade body region, made as a solid body and having a maximum wall thickness of 2 mm, and a root region of solid material having a markedly larger extent. The method of producing long thin moving blades or guide blades in a gas turbine, for reasons of cost, is preferred to methods of producing directionally solidified turbine blades or turbine blades solidified in a single-crystal form.

U.S. Pat. No. 3,465,812 likewise describes the casting of turbine blades having a solid profile.

A method of producing a hollow body which is cast in one piece, can be subjected to a high temperature and has a thin wall is specified in Published, European Patent Application EP 0 750 956 A2. A corresponding casting mold for such a hollow body consists of a ceramic core, which is surrounded by wax and in which a thin silicate layer is applied around the wax. The silicate layer being connected, on the one hand, to the ceramic core and, on the other hand, to a further ceramic envelope in such a way that no deformations occur during the pouring of metal. The wall thicknesses which can be achieved with the method are between 0.25 mm and 1 mm for random solidification, and in the range between 0.076 mm and 1 mm for directionally solidified and single-crystal structures. The preferred field of application of the method is the production of single-crystal structures, for example for wings of orbital gliders, or gas-turbine guide blades as deflecting nozzles for aircraft engines. The method serves to raise the temperature stability of the hollow bodies cast in this way up to 2300° C.

A method for the thermally controlled solidification of large castings having regions of thin wall structure is described in the article titled "A Thermal Analysis From Thermally Controlled Solidification (TCS) Trials On Investment Castings" by Patrick D. Ferro, Sanjay B. Shendye in "Superalloys", 1996, pages 531 to 535, The Minerals, Metals and Materials Society 1996. A casting produced according to this method differs from a directionally solidified casting or a single-crystal casting in particular by the grain size. Directionally solidified and single-crystal castings are distinguished by large and average grain sizes; in contrast, a casting produced according to the thermally controlled solidification method has an average grain size like a conventionally produced casting. In addition, a casting produced according to the thermally controlled solidification method has a consistent and uniform grain size in all the casting regions. A ratio of the temperature gradient G to the solidification speed R that leads to a microstructure having relatively small, equiaxed grains and minimal shrinkage is used in the thermally controlled solidification method. The method is carried out in a vacuum furnace in which a casting mold is heated via an induction heating system in a heating zone and is moved out of this heating zone for the solidification of the molten metal, so that cooling and solidification of the molten metal are effected by radiation cooling. The production of a casting mold and the construction of a corresponding furnace are described, for example, in U.S. Pat. No. 4,724,891. Described in this document is the production of a turbine-plant casing part, regions of which have a thin wall structure having an area of over 30 $cm^2$ and a wall thickness of less than 0.125 cm. The ratio of the area of the region having a small wall thickness to the wall thickness is around at least 40.

SUMMARY OF THE INVENTION

It is accordingly an object of the invention to provide a turbine blade and a method of producing the turbine blade that overcome the above-mentioned disadvantages of the prior art devices and methods of this general type.

With the foregoing and other objects in view there is provided, in accordance with the invention, a turbine blade, containing:

a turbine body having a main axis and a blade wall with a given wall thickness, the turbine body including:

a root region;

a blade body region extending from the root region and along the main axis; and a tip region extending from the blade body region and along the main axis;

the turbine body having a cavity formed therein at least in the blade body region, at least regions of the cavity being surrounded by the blade wall, the blade wall formed of a metallic material with a random grain structure with an average grain size in an order of magnitude of a grain size of a conventionally cast material.

According to the invention, the object which relates to a turbine blade is achieved by a turbine blade which extends along a main axis from a root region over a blade body region to a tip region and has a cavity at least in the blade body region. At least regions of the cavity are surrounded by a blade wall of a small wall thickness, the blade wall is formed of a metallic material with an average grain size in the order of magnitude of the grain size of a conventionally cast material. In this case, the grain structure is essentially random, i.e. quasi-isotropic. Compared with turbine blades solidified in a single-crystal form or directionally solidified turbine blades, an equiaxed grain structure, in which the grains are oriented essentially without a privileged direction, is therefore present.

Inter alia, the blade weight is reduced by providing a cavity in the turbine blade. If the material solidifies free of defects, in particular free of shrink holes and pores, shrinkage which occurs during the solidification is compensated for by a following melt of the material. This is achieved, for example, by use of a thermally controlled solidification method. The shrinkage may be compensated for by the wall thickness increasing continuously from the tip region to the root region at least from a certain distance from the tip region. As a result, the melt of an alloy solidifies quicker in the tip region than in the root region. By the use of a thermally controlled solidification method, the wall thicknesses can be adapted in accordance with the requisite strength, so that a reduction in the weight of the turbine blade can be achieved. This ensures a reduction in the loading of the root region, in which the turbine blade is anchored in a turbine shaft, as a result of centrifugal forces that occur. The turbine blade may also be of a partly hollow configuration in the root region.

The cross-sectional area in a plane perpendicular to the main axis preferably increases from the tip region toward the root region. The cross-sectional area preferably lies within a range of 500 $mm^2$ to 10,000 $mm^2$. The cross-sectional area may be largely constant over a preset length, determined in accordance with the requisite strengths, from the tip region into the blade body region. In this region, the blade wall has a parallel configuration, as opposed to a necessarily conical profile of known turbine blades, which are not solidified in a single-crystal form or directionally solidified. Further into the blade body region in the direction of the root region, the cross-sectional area may in particular increase exponentially. The wall thickness increases, preferably starting from the tip region, in the direction of the root region. This may preferably be accompanied by the reduction in the size of the cavity.

The length over which the cross-sectional area is essentially constant from the tip region in the direction of the root region is preferably between 15% and 40% of the total height of the blade body region. The height of the blade body region is preferably between 5 cm and 70 cm. Turbine blades of large height are used in particular in stationary gas turbines. For turbine blades of a stationary gas turbine, adaptation of the process parameters of the thermally controlled solidification method may be necessary.

The turbine blade, in a direction perpendicular to the main axis, has an extent that is characterized by a distance between a leading region and a trailing region, this distance preferably decreasing from the root region toward the tip region.

The turbine blade is preferably a moving blade or a guide blade of a gas turbine, in particular a stationary gas turbine. In this case, it is preferably made of a nickel-base or cobalt-base superalloy, such as CM 247LC, Rene 80, IN 792, IN 738LC or IN 939. Of course, depending on the requirements imposed on the turbine blade, further superalloys, as known from the literature, are also suitable.

The wall thickness of the blade wall preferably has a minimum value that lies between 0.5 mm and 5 mm.

The object that relates to a method of producing a turbine blade which extends along a main axis from a root region over a blade body region to a tip region is achieved by a method in which a cavity is produced in the blade body region in which at least regions of the cavity are surrounded by a blade wall of a small wall thickness. In the method a casting mold is held, in a heating zone, above the melting temperature of the material of the turbine blade, the casting mold being filled with a molten material, and the casting mold is moved out of the heating zone in such a way that the material, at least in the blade wall, has a small average grain size like a conventionally cast material. In this case, the grain size, in the blade wall, may be between 0.5 mm and 5 mm and, for example in the blade root, may lie approximately within the range of 4 mm to 10 mm. If need be, there may be only a few grains in the cross section of the blade wall. Of course, the fact that the casting mold is moved out of the heating zone also includes a situation in which the casting mold is stationary and the heating zone, in particular represented by an induction heating system, is moved away from the casting mold.

A turbine blade having markedly different wall thicknesses and if need be regions of solid material can be produced by such a method, in which turbine blade the alloy is free of pores and shrink holes and has largely the same grain structure in the entire turbine blade. A turbine blade having a small cross-sectional profile and thus a light weight can be produced by the method, as a result of which a reduction in the mechanical loading of a turbine root, which is attached in a rotor of a gas turbine for anchorage, and in the loading of the rotor itself, is achieved. This likewise enables a turbine blade to be produced with a long blade body region, in particular for use in a stationary gas turbine at high temperatures of well above 1000° C. The alloy, in particular a cobalt alloy, may also be cast in a furnace and then cooled down outside the furnace in a controlled manner. The alloy is preferably cast as a precision casting.

Other features which are considered as characteristic for the invention are set forth in the appended claims.

Although the invention is illustrated and described herein as embodied in a turbine blade and a method of producing the turbine blade, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
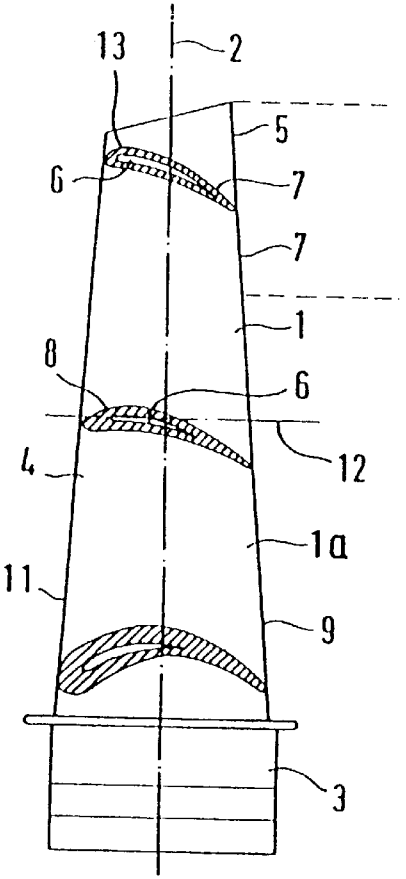
FIG. 1 is a diagrammatic, longitudinal view of a turbine blade according to the invention.

In all the figures of the drawing, sub-features and integral parts that correspond to one another bear the same reference symbol in each case. Referring now to the figures of the drawing in detail and first, particularly, to FIG. 1 thereof, there is shown a longitudinal view of a turbine blade 1, which extends along a main axis 2 from a root region 3 over a blade body region 4 to a tip region 5. A cross-sectional area 13 of the turbine blade 1 is in each case shown schematically in three planes 12 that are perpendicular to the main axis 2. In the blade body region 4, the turbine blade 1 has a cavity 6 in a direction of the tip region 5, so that the turbine blade 1 has a blade wall 7 with regions of small wall thickness. In a direction of the root region 3, the blade body region 4 has a hollow cross section, through which a core keeping the cavity 6 clear can be removed. The turbine blade 1 has a leading region 11 for an incident flow of a hot gas 10 and a trailing region 9. The leading region 11 and the trailing region 9 are at a distance D (see FIG. 3) from one another perpendicular to he main axis 2. The distance D decreases continuously from he blade root region 3 toward the tip region 5.

Figure 3:
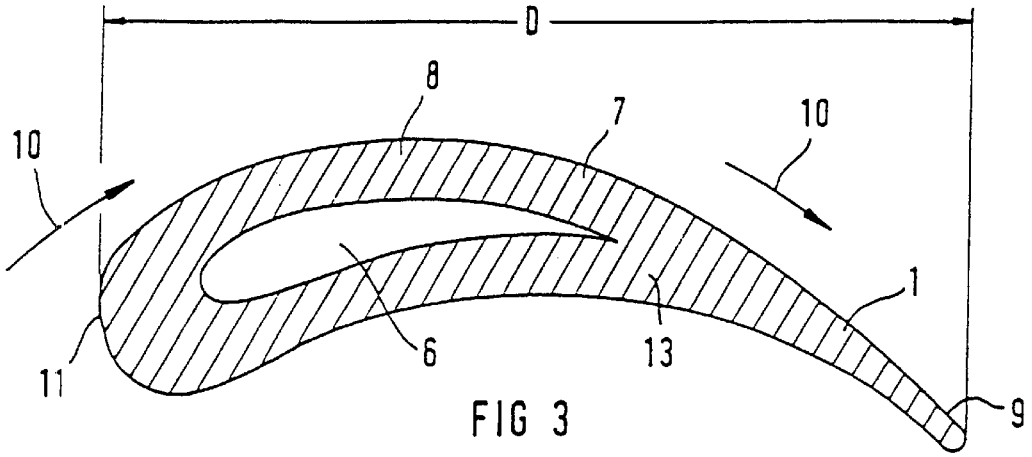
FIG. 3 is a cross-sectional view through the turbine blade.

A cross section through the turbine blade 1 in the plane 12 is shown in FIG. 3. The hot gas 10 flows around the turbine blade 1 from the leading region 11 in a direction of the trailing region 9.

Figure 2:
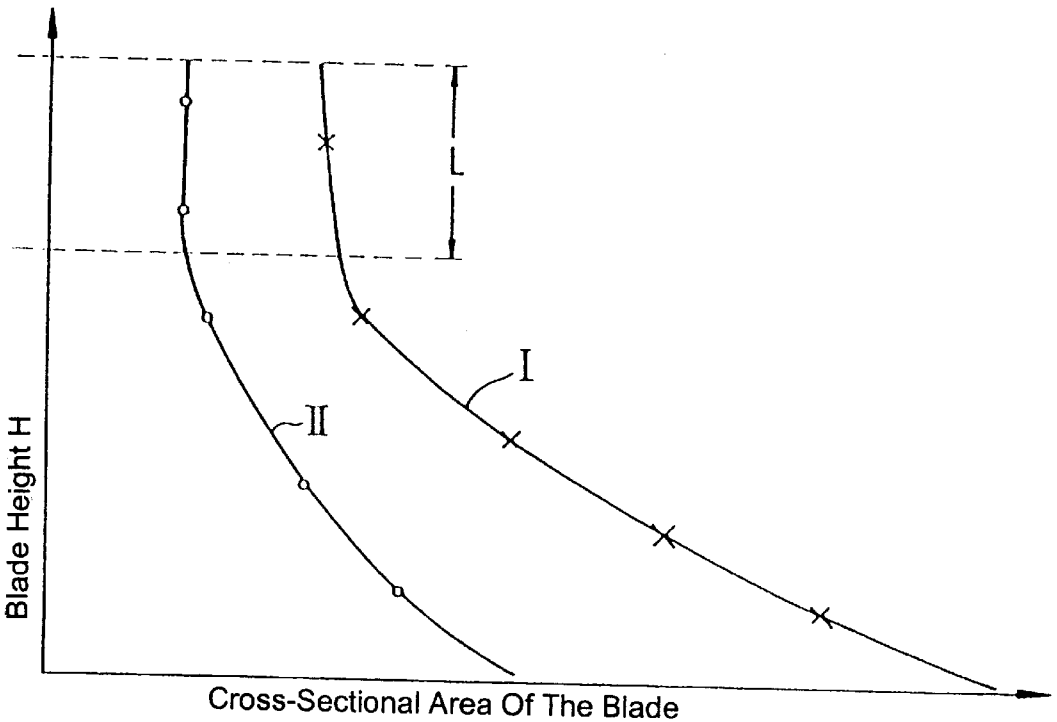
FIG. 2 is a graph showing a relationship between a cross-sectional area of the turbine blade over a height of the turbine blade.

The cross-sectional area of the turbine blade 1 over the height H of the turbine blade 1 is shown in FIG. 2. Curve II shows that from the tip region 5 into the blade body region 4, the cross-sectional area is essentially constant over a length L. Further in the direction of the root region 3, the cross-sectional area of the turbine blade 1 increases continuously, in particular exponentially. Compared with this, in curve I, the cross-sectional area which is produced according to a conventional casting process is shown over the blade height H of the turbine blade 1. The cross-sectional area of the turbine blade thus produced in curve I increases continuously from the tip region 5 to the root region 3 in order to compensate for the shrinkage occurring during the solidification. In addition, the conventional casting process requires a minimum wall thickness at the tip region of the turbine blade, so that the wall thicknesses in the tip region 5, which are related to the conventional casting process, and in the blade body region 4 facing the tip region 5 are greater than the wall thickness actually required by the material strength. The additional mass resulting from this in the tip region 5 leads to a great increase in the centrifugal-force loading in the root region 3, and this increase in the centrifugal-force loading, for strength reasons, requires an increase in the cross section of the turbine blade 1 in the root region 3. These restrictions of the conventional casting process lead to markedly heavier turbine blades than would be required for reasons of strength. In addition, the loading in the root region 3, with which the turbine blade 1 is fastened in a rotor of a gas turbine, and the loading in the rotor itself also increase with the weight of the turbine blade 1. On the other hand, turbine blades of lower weight and greater height are simple to produce by the production of the turbine blade 1 with a controlled thermal solidification, in which the alloy is free of pores and shrink holes and has a structure with an equiaxed solidified grain structure.

Figure 4:
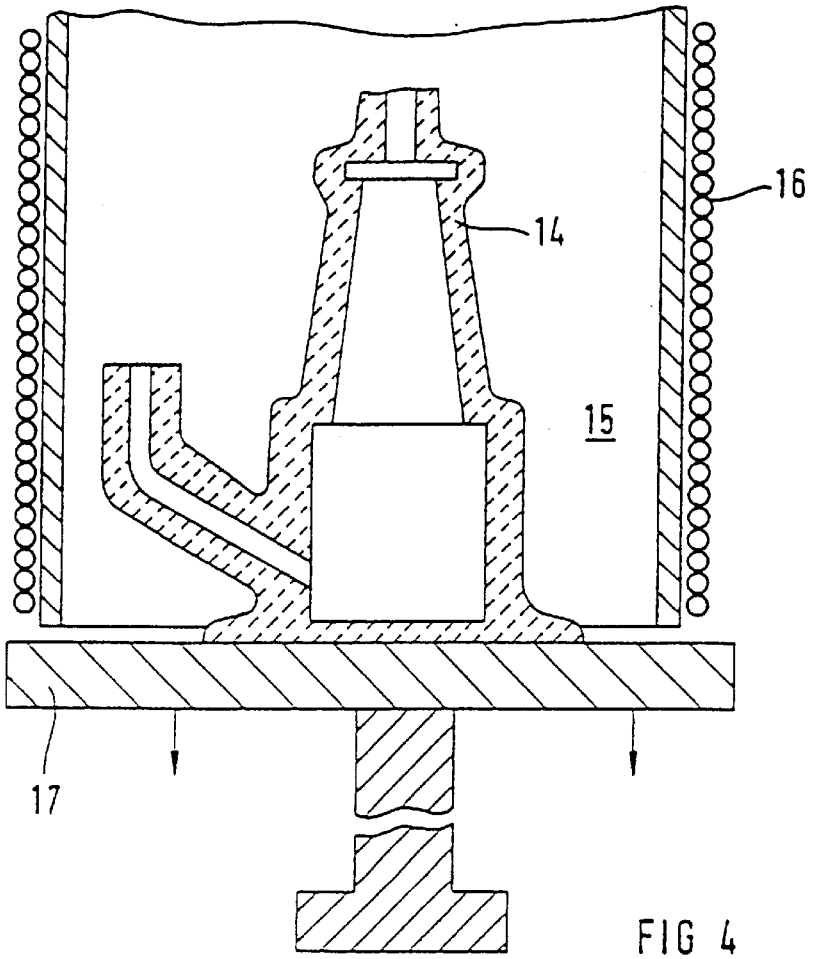
FIG. 4 is a fragmented, sectional view of a detail of an apparatus for a thermally controlled solidification of the turbine blade.

FIG. 4, in a longitudinal section, shows a detail through a heating zone 15, which is disposed in a non-illustrated vacuum furnace. A casting mold 14 for the turbine blade 1 is shown in the heating zone 15. The casting mold 14 is disposed on a supporting plate 17 and is surrounded by an induction heating system 16. The casting mold 14 is closed toward the supporting plate 17. The casting mold 14 is heated to a temperature above the material to be solidified therein, in particular a nickel-base or a cobalt-base superalloy. The molten material is poured into the casting mold 14, and then the casting mold 14 is moved out of the induction heating system 16 at a predetermined speed or the induction heating system 16 is moved in the vertical direction away from the casting mold 14 at a predetermined speed. The method is carried out in a similar manner to the method of thermally controlled solidification described in the article "Thermal Analysis From Thermally-Controlled Solidification (TCS) Trials On Large Investment Castings" by Patrick D. Ferro et al., the process parameters being modified in accordance with the production of, in particular, large turbine blades, as for a stationary gas turbine.

The invention is distinguished by a turbine blade which has a material, in particular a nickel-base or cobalt-base superalloy, which has a structure which is essentially free of shrink holes and pores and has an average grain size similar to a conventionally cast material. The turbine blade can be produced by a thermally controlled solidification method even in the region of thin wall thickness. The method is distinguished, inter alia, by the fact that the turbine blade has essentially the same grain structure even in regions of different wall thickness and in regions of solid material. This permits the production of turbine blades for higher material temperatures and having a longer blade body region than turbine blades produced by conventional casting processes. Large thin-walled hollow turbine blades, as used, for example, in the last stages of a stationary gas turbine, can likewise be produced.

We claim:

1. A method of producing a gas turbine blade extending along a main axis from a root region over a blade body region to a tip region and having a cavity formed therein in at least the blade body region, at least regions of the cavity being surrounded by a blade wall of given wall thickness, the method which comprises:

holding a casting mold in a heating zone being above a melting temperature of a material forming the turbine blade;

filling the casting mold with the material being in a molten state; and moving the casting mold out of the heating zone such that the material, at least in the blade wall, having a random grain structure with an average grain size of an equi-axed cast material.

2. The method according to claim 1, wherein the blade body region has a height and the given length is between 15% and 40% of the height of the blade body region.

3. The method according to claim 2, wherein the height of the blade body region is between 5 cm and 70 cm.

4. The method according to claim 1, wherein the turbine body has a leading region and, at a distance therefrom, a trailing region for a hot fluid, the leading region and the trailing region each extending from the root region to the tip region, and the distance between the leading region and the trailing region decreasing in a direction of the tip region.

5. The method according to claim 1, wherein the material is a material selected from the group consisting of a nickel-base superalloy and a cobalt-base superalloy.

6. The method according to claim 1, wherein the given wall thickness of the blade wall has a minimum value of between 0.5 mm and 5 mm.

7. The method according to claim 1, wherein the turbine body is a moving blade of a gas turbine.

8. The method according to claim 7, wherein the gas turbine is a stationary gas turbine.

9. The method according to claim 1, wherein the turbine body is a guide blade of a gas turbine.

10. The method according to claim 9, wherein the gas turbine is a stationary gas turbine.

11. A method of producing a gas turbine blade, which comprises:

providing a casting mold for a gas turbine blade, the gas turbine blade extending along a main axis from a root region of a blade body region to a tip region and having a cavity formed therein in at least the blade body region, at least regions of the cavity being surrounded by a blade wall having a given wall thickness, the casting mold defining a turbine body with a cross-sectional area in a given plane perpendicular to the main axis, the cross-sectional area decreasing in a direction of the tip region and being substantially constant from the tip region in a direction of the root region over a given length;

holding the casting mold in a heating zone being above a melting temperature of a material forming the gas turbine blade;

filling the casting mold with the material being in a molten state; and moving the casting mold out of the heating zone such that the material, at least in the blade wall, has a random grain structure with an average grain size of an equi-axed cast material.

* * * * *